US006170803B1

(12) United States Patent
Liberfarb

(10) Patent No.: US 6,170,803 B1
(45) **Date of Patent: *Jan. 9, 2001**

(54) LEVERAGE TOOL FOR OPENING STICKING WINDOWS

(76) Inventor: Sidney Liberfarb, 54 Harrington Farms Way, Shrewsbury, MA (US) 01545

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/099,808

(22) Filed: Jun. 18, 1998

(51) Int. Cl.[7] ..... B66F 3/00

(52) U.S. Cl. ..... 254/131; 254/130; 254/120; 254/129

(58) Field of Search ..... 254/131, 129, 254/130, 120

(56) References Cited

U.S. PATENT DOCUMENTS

| | | | | |
|---|---|---|---|---|
| 373,744 | * | 11/1887 | Larkin | 254/131 |
| 1,048,841 | * | 12/1912 | Locke | 254/131 |
| 1,342,057 | * | 6/1920 | Miller | 254/131 |
| 1,392,885 | * | 10/1921 | Battelle | 254/131 |
| 1,736,585 | * | 11/1929 | Fehlhaber | 254/120 |
| 1,960,255 | * | 5/1934 | Tyroff | 254/130 |
| 2,010,680 | * | 8/1935 | Leuven | 254/131 |
| 2,670,923 | * | 3/1954 | Chiles | 254/129 |
| 2,766,008 | * | 10/1956 | Hurd | 254/129 |
| 4,334,669 | * | 6/1982 | Ross | 254/131 |
| 4,830,338 | * | 5/1989 | Hannigan | 254/130 |

* cited by examiner

*Primary Examiner*—David A. Scherbel
*Assistant Examiner*—Lee Wilson
(74) *Attorney, Agent, or Firm*—Mirick, O'Connell, DeMallie & Lougee, LLP

(57) ABSTRACT

A leverage tool for opening lower halves of firmly sticking double-hung windows consisting of a vertical fulcrum and lever assembly small enough to be placed on inner window sills yet sturdy enough to overcome the resistive forces that cause windows to stick.

Accessory focal or lifting points necessary to facilitate the leveraging action of the tool and to minimize the possiblity of damage to the frame or sill incidental to a leveraging operation are supplied. They are to be attached by the user to window frames lacking a suitable focal point, preferably close to the central portion of the bottom frame member.

To leverage open a sticking window frame, bottom crossbars on the lever are placed under the focal point. Another set of crossbars an inch above the lower set are then positioned within one of the lower ratcheting indents on the fulcrum When the tool is positioned as described, the fulcrum will be resting on an inner window sill with the lever's handle portion facing away from the window frame. The leveraging operation begins when the user pushes firmly downward on the lever handle. This movement causes the lever's lower crossbars to transmit an upward lifting force against the focal point generally sufficient to overcome the forces causing the window frame to stick.

7 Claims, 7 Drawing Sheets

LEVERAGE TOOL FOR OPENING STICKING WINDOWS

BACKGROUND OF THE INVENTION

1. Field of the Invention

The field of this invention is that of leverage tools. The disclosed invention is a leverage tool for opening firmly sticking bottom halves of double-hung windows using an assembly of a specially designed lever and fulcrum.

2. Description of the Prior Art

The principles and applications of the lever and fulcrum as a contrivance for lifting or moving large weights or resistive objects a small distance with each throw of the lever has been known and used by laborers as well as sophisticated riggers, engineers, and builders from earliest civilizations until the present. In modern times there has been a proliferation of leverage tools for use in all manner of applications. However there is no known prior art in a lever and fulcrum assembly designed specifically for leveraging open firmly stuck bottom halves of double-hung windows.

SUMMARY OF THE INVENTION

When lower halves of double-hung windows slide freely in their frame guides they are easy to open manually by moderate upward finger and hand pressure against upper or lower horizontal window frame members. Some of these windows are manufactured with a fingerhold on a lower frame member to help in their opening. Some householders attach special hardware made in the form of fingerholds for the same purpose, especially if the windows are held a little to tight by frame guides. When, fogy of a number of reasons lower half of a double-hung window becomes firmly stuck in the closed position it generally cannot be opened by manual force alone. If screwdrivers and other inappropriate tools are used as levers in an attempt to pry open a sticking window, considerable damage to its frames and sills may result.

One of the purposes of the disclosed invention is to provide householders and handy persons with a tool that minimizes almost entirely the chances of damage when it is used to force open a sticking window. Use of initial force in such situations generally must precede other means to restore the ease with which a properly installed window should yield to routine opening and closing.

The disclosed invention consists essentially of two parts: a separate lever and fulcrum that can be temporarily assembled as an embodiment for placement on inner window sills of sticking lower window frames to leverage them open when they are firmly stuck in the closed or partially open position. The lever has two sets of horizontal crossbars. One set is located at the tip end opposite the handle area. The other set is approximately one inch above. The fulcrum has a level rectangular base, and an upright four sided body ninety degrees verticle to the base; the two wider verticle sides are pierced by a central, narrow, aperture. One of the wider sides has upwardly stepped ratcheting type indents along most of its length. The indents straddle the aperture.

When the disclosed tool is properly assembled and placed in a central position on an inner window sill of a sticking window frame that is fully closed, the crossbars at the tip of the lever are designed to fit under an existing fingerhold which may be used as a focal point or a focal point that has been installed on a lower horizontal window frame member by a user. When the lever's lower cross bars are in that position, the upper crossbars are spacially located to fit into the lowest ratcheting indent on the side of the fulcrum facing the window frame. If a lower window frame is stuck in a partially open position of only a few inches, the lever's lower crossbars may still be placed under a usable focal point on the lower horizontal window frame member, but the choice of a ratcheting indent on which the upper cross bars should be placed will depend on the height of the opening at which the window frame became stuck.

In either case, whether a stuck window frame is fully closed or partially open, when the disclosed leverage tool is positioned on an inner window sill in one of the operational positions described above, a firm downward thrust of the lever handle will force the lever's lower set of crossbars to exert an upward force against the focal point being used. This upward force, if strong enough, should overcome the forces causing the window frame to stick, resulting in a small initial upward movement of the window frame.

With the lever's lower set of crossbars still under the focal point being used, repeated repositioning of the lever's upper crossbars into a higher ratcheting indent on the fulcrum after each downward throw of the lever handle should increase the height of the window opening until the upper indent on the fulcrum is reached. This height is approximately five inches. If the window frame is still sticking firmly at this point additional opening height may be gained by placing a level block of wood or other available material several inches thick under the base of the fulcrum and restarting the leveraging operation from this added height.

There is, however, practical limit to the height above a window sill at which the disclosed tool can be operated. To gain additional height by using more than one block of material on top of another does not provide as stable a base for operation as the window sill itself. Instability might also occur because of excessive height of operation. An attempt to operate the disclosed tool above say eight or nine inches is not recommended because instability during its operation may result in overturning. If this should happen there is a possibility of damage to window elements and injury to a user.

The intended task of the disclosed leverage tool is not to force open mildly sticking windows. Such cases can usually be dealt with by manual efforts and subsequent use of window lubricants and other means. Nor can the tool be used to close lower window frames that are stuck in an open position. The primary purpose of the disclosed invention is to serve as a basic do-it-yourself tool for helping householders and handy persons return a badly sticking lower window frame to a normal operating condition. In all cases, the user of the disclosed tool will have to exercise some independent judgement as to the best way to accomplish this. To completely remedy a sticking window problem a householder may have to use other practical measures in conjunction with use of the disclosed tool.

The lever portion of the disclosed tool has already been briefly described. It may also be characterized as multipurpose in that it is adaptable to various kinds of focal points including fingerholds built into lower horizontal window frame members or accessory focal points attached by a householder. When there is a suitable focal point already in place, the disclosed tool can be quickly assembled and deployed with little further preparation. For window frames lacking a suitable focal point the accessory focal point fittings which are part of the disclosed invention are available for user installation. The availability of these accessory focal points should prove to be important for householders whose homes are of an older vintage because wood frame windows in older homes are more likely to stick because of age related problems. The most suitable position for attaching one of the accessory focal point fittings supplied with the disclosed invention is in a central position on a lower horizontal window frame approximately an inch above an inner window sill when the window frame is in the closed position.

The accessory focal point fittings are supplied in two variations. Both are alike in all respects except that one variation is made of high tensile strength aluminum out of consideration for similarity of metals if the fitting is to be left permanently on an aluminum framed window after being attached as a focal point for leveraging purposes. The non-aluminum fitting should be made of high tensile strength brass or other ornamental metal for use on the more numerous wood and wood composition windows found in conventional housing. Some high tensile strength synthetic materials may also be considered for use as accessory focal points. But whatever the material selected for these user installed focal points, they and the screw fasteners used with them should be strong enough to withstand the resistive forces of a firmly stuck window when maximum force is applied against them by the leveraging action of the disclosed tool. Also the fittings furnished with the invention package should have a finished appearance so that if householders choose to leave them on window frames permanently they will not detract overly from the decor of a well appointed room.

A householder in possession of the disclosed average tool and accessory fittings having ordinary skills in the use of tools should have few problems trying to remedy a run of the mill sticking window problem. This tool may not help in remedying certain complex problems of sticking windows such as, for example, those brought on by settling of a wall and subsequent distortion of a window casement. Such repairs are best left to skilled carpenters or other qualified professionals.

After a user of the disclosed tool opens a sticking window frame to a point where no further sticking is apparent, the tool may be removed from the window sill and the opening and closing status of the window frame along the entire length of its frame guides may be tested manually If the sticking condition has been remedied by the leveraging operation no further action seems called for except possibly limited treatment of the frame guides with an accepted window lubricant. If, however, some stickiness persists a householder may repeat the leveraging process and lubrication until satisfactory results are obtained.

DESCRIPTION OF THE PREFERRED EMBODIMENT

Figure 5:
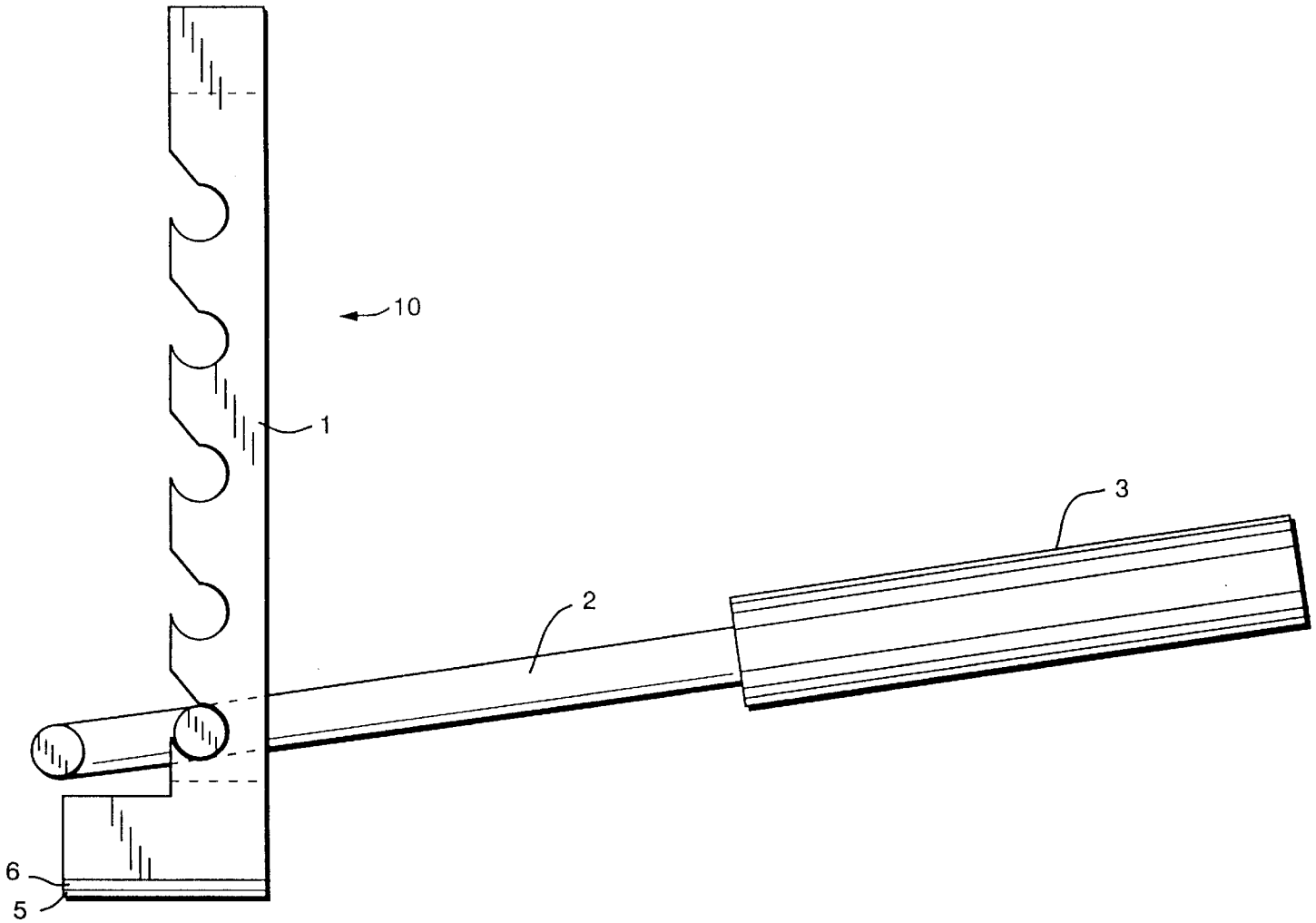
FIG. 5 is a side view of the assembly of the disclosed lever and fulcrum that constitutes the complete embodiment, 10.

The preferred embodiment, 10, as shown in FIG. 5, is a leverage tool for opening firmly stuck lower halves of double-hung windows. The tool is simple in design, consisting of a separable assembly of two parts: a fulcrum with upwardly stepped ratcheting type indents and a lever designed to use the ratcheting means. The design feature that allows the lever to be assembled with the fulcrum and make use of its ratcheting means is the fulcrum's centrally located, verticlly slotted aperature, closed at the top and bottom, dimensioned just wide enough to allow the lever shaft to be inserted through it to form an assembly for use on the relatively narrow inner window sills common to almost all household window installations.

Figure 1:
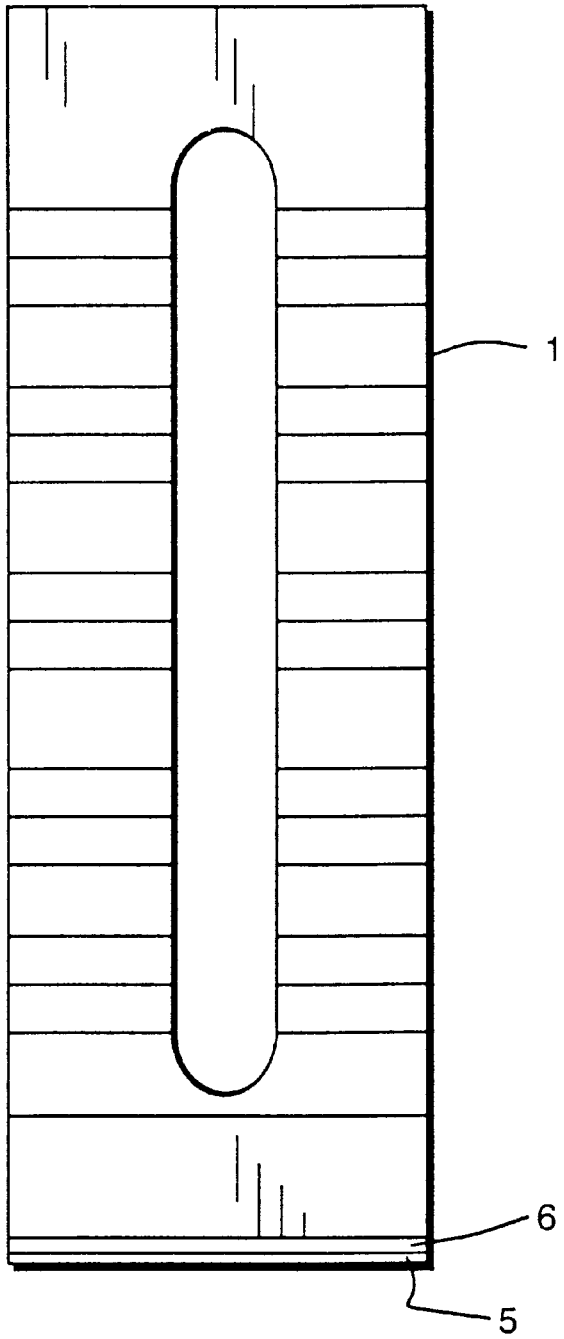
FIG. 1 is a front view of the fulcrum, part 1. This view also shows part 5, a thin elastomeric pad cemented to the base of 1 with a compatible adhesive, part 6.

FIG. 1 is a front elevation of the fulcrum, part 1, showing the centrally located aperature cutting through its body and bisecting the horizontal indents that make up its ratcheting means. The aperture is important to the working of the disclosed tool because when the lever, part 2, is inserted through it to form the embodiment, 10, the aperture's verticle length allows the lever to be repositioned in steps from the lowest to the highest of the fulcrum's ratcheting indents.

Figure 2:
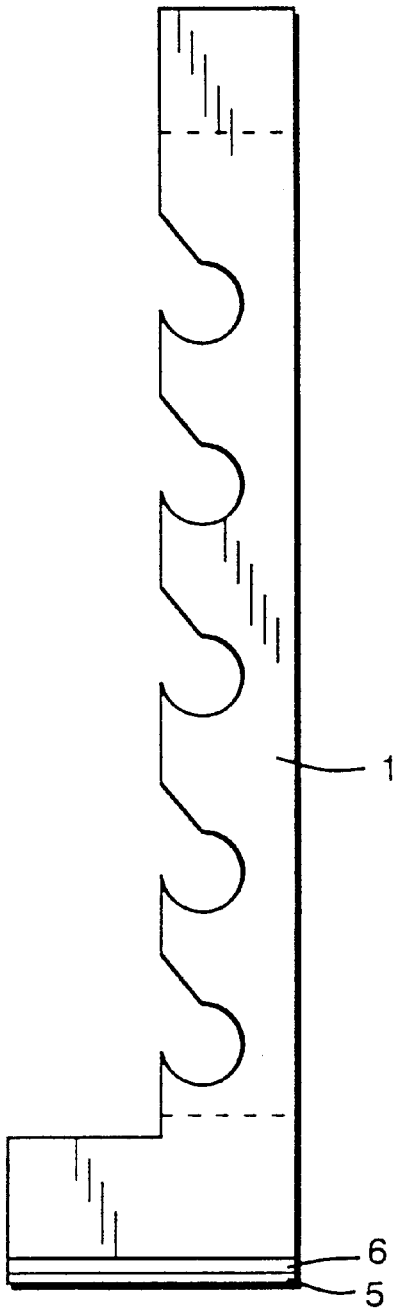
FIG. 2 is a side view of part 1, showing in detail the indents on 1 used for gaining incremental window opening height in conjunction with the lever, part 2.

FIG. 2, is a side elevation of part 1. It shows the dimensional similarity of the stepped indents on its front surface that are used for the upward repositioning of the lever during leveraging operations. FIG. 2 also shows part 6, an elastomeric pad and part 5 a suitable adhesive for attaching 6 to the base of 1.

Figure 3A:
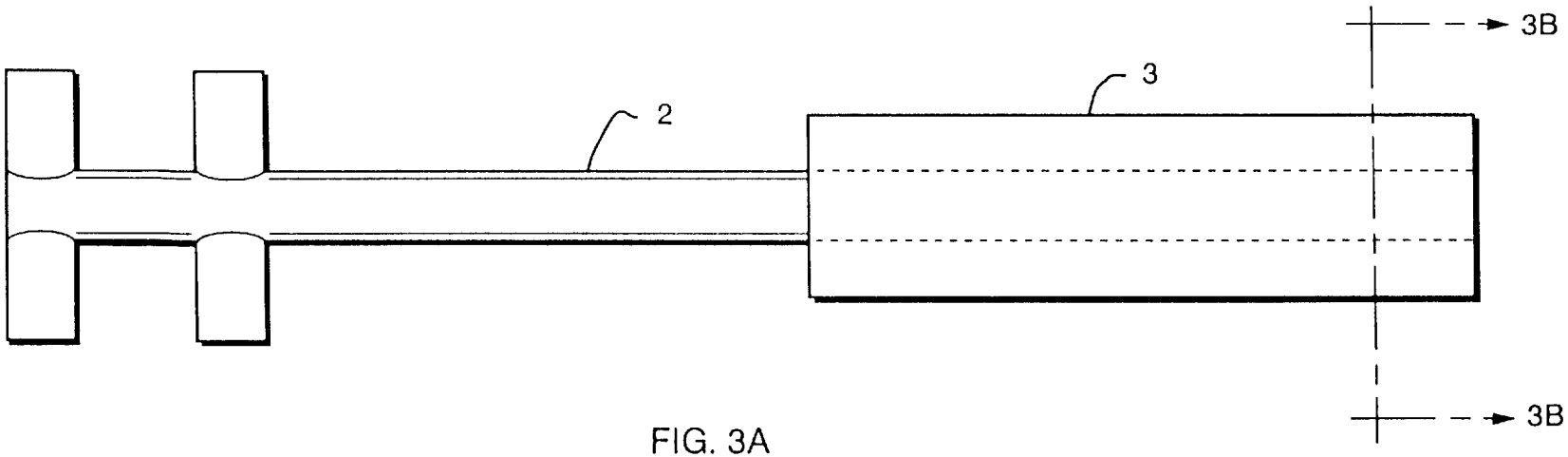
FIG. 3A is a plan view of the lever, part 2.
Figure 3B:
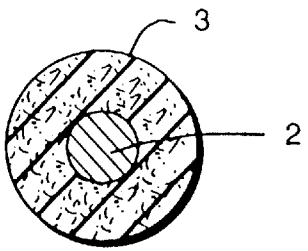
FIG. 3B is a section through the handle end of 2, showing the flexible material, part 3, that provides a comfortable grip to that end of the lever shaft.

FIGS. 3A and 3B show the design features of the lever, part 2. It is essential that the lever be made of a material that will not bend, flex, or break during leveraging operations on firmly stuck windows. For the comfort of users the handle area is fitted with an encompassing length of elastometric material, part 3. Both sets of crossbars opposite the handle area are of the same diameter as the main shaft; the lower crossbars are designed to engage a variety of focal points found or installed on the lower frames of double-hung windows, including the accessory focal point fittings, part 4, of the disclosed invention. The upper crossbars are designed to fit the ratcheting indents on the fulcrum, part 1.

Early in the planning stages of the disclosed invention, consideration was given to the design of a lever that could be assembled with the fulcrum by sliding a rectanglular shaped mid-section of a lever shaft down over the top of the fulcrum until a crossbar that would be part of the rectangular section, rested on the lowest ratcheting indent on the fulcrum. This design would also have eliminated the need for an aperture in the fulcrum, and would still result in a separable rather than a permanent assembly of the lever and fulcrum, a feature that makes it easier to store the tool when it is not in use. It was finally decided that the alternate plan though practicable would not result in greater simplicity of design or do a better job of leveraging open sticking windows, and might lead to higher manufacturing costs.

Figure 4A:
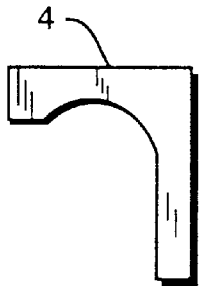
FIG. 4A is a side elevation of part 4, an accessory focal point fitting.
Figure 4B:
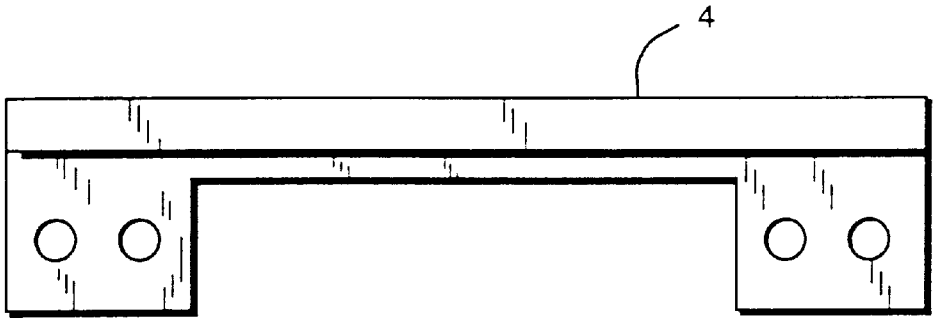
FIG. 4B shows part 4 in front elevation.

FIGS. 4A and 4B show the details of the accessory focal points which are part of the disclosed invention. There are two versions of these fittings, similar in all respects except that one version is of a hardened grade of aluminum for use with aluminum window frames, and the other version is of a hardened ornamental metal suitable for use with wood frame or composition window frames generally found in homes and some office type commercial buildings. A high strength synthetic may also be a suitable material for an alternate variation of this essential part.

FIG. 5 is a side elevation of the embodiment, 10, ready for use. The assembly of the fulcrum and the lever has been accomplished by inserting the lever through the central aperture in the fulcrum from the direction of its unindented vertical side. The lever's upper set of crossbars is shown in place on the lowest ratcheting indent on the fulcrum; this is the normal position for the crossbars when the embodiment is to be used to leverage open a closed window.

Figure 6:
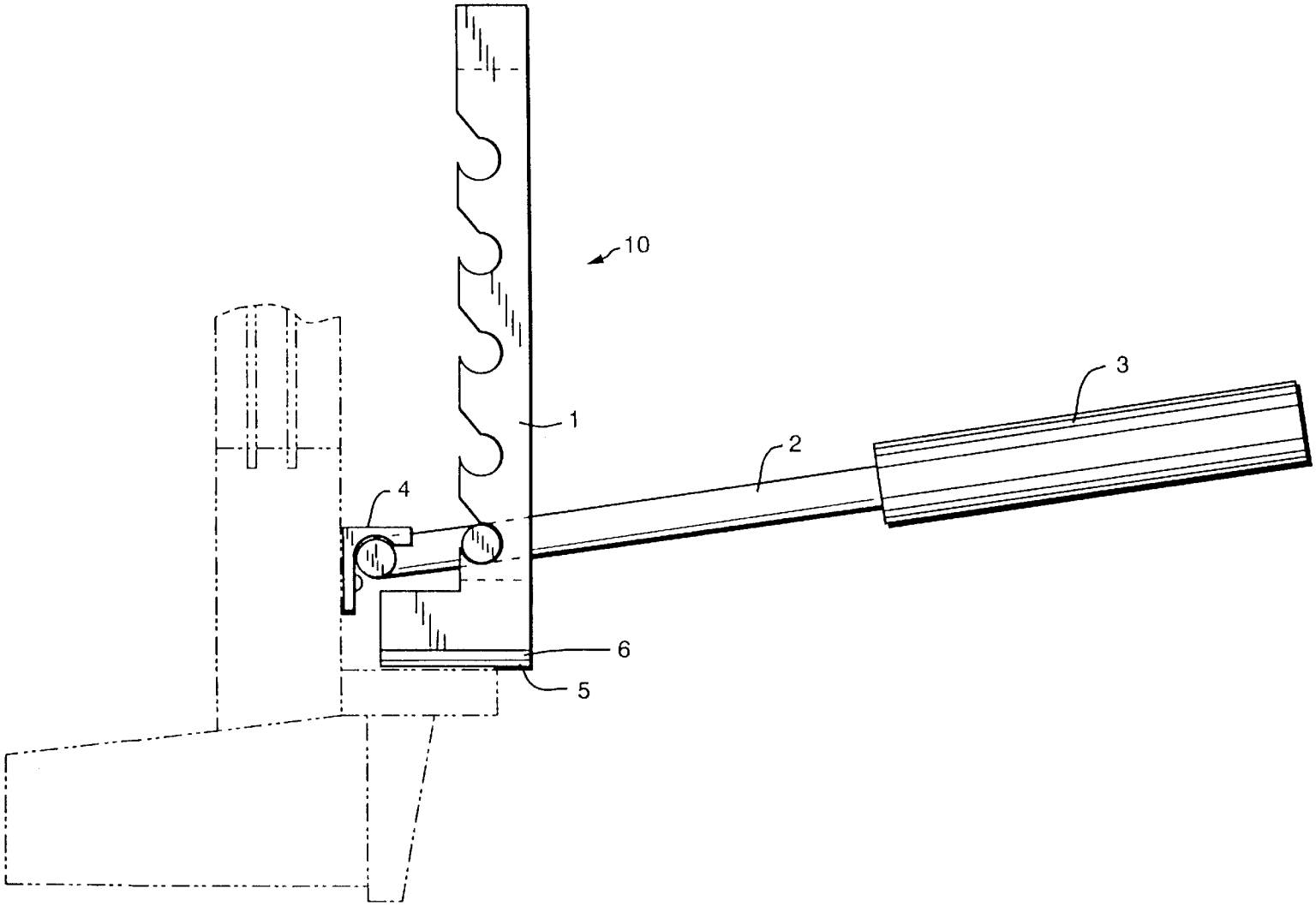
FIG. 6 is a side view of the embodiment, 10, in place on a simulated inside window sill; part 4, an accessory focal point is shown attached to the frame of the simulated window. The lever's lower crossbars are positioned under 4; the upper crossbars are resting on the fulcrum's lowest indent.

FIG. 6 shows the embodiment, 10, properly positioned on the inner window sill of a simulated sticking window. The lever's lower crossbars are under focal point, 4, which has been installed on the window frame. The lever's upper crossbars are resting on the fulcrum's lowest ratcheting indent. A leveraging operation will normally begin with the crossbars in these positions when a window is closed.

Figure 7:
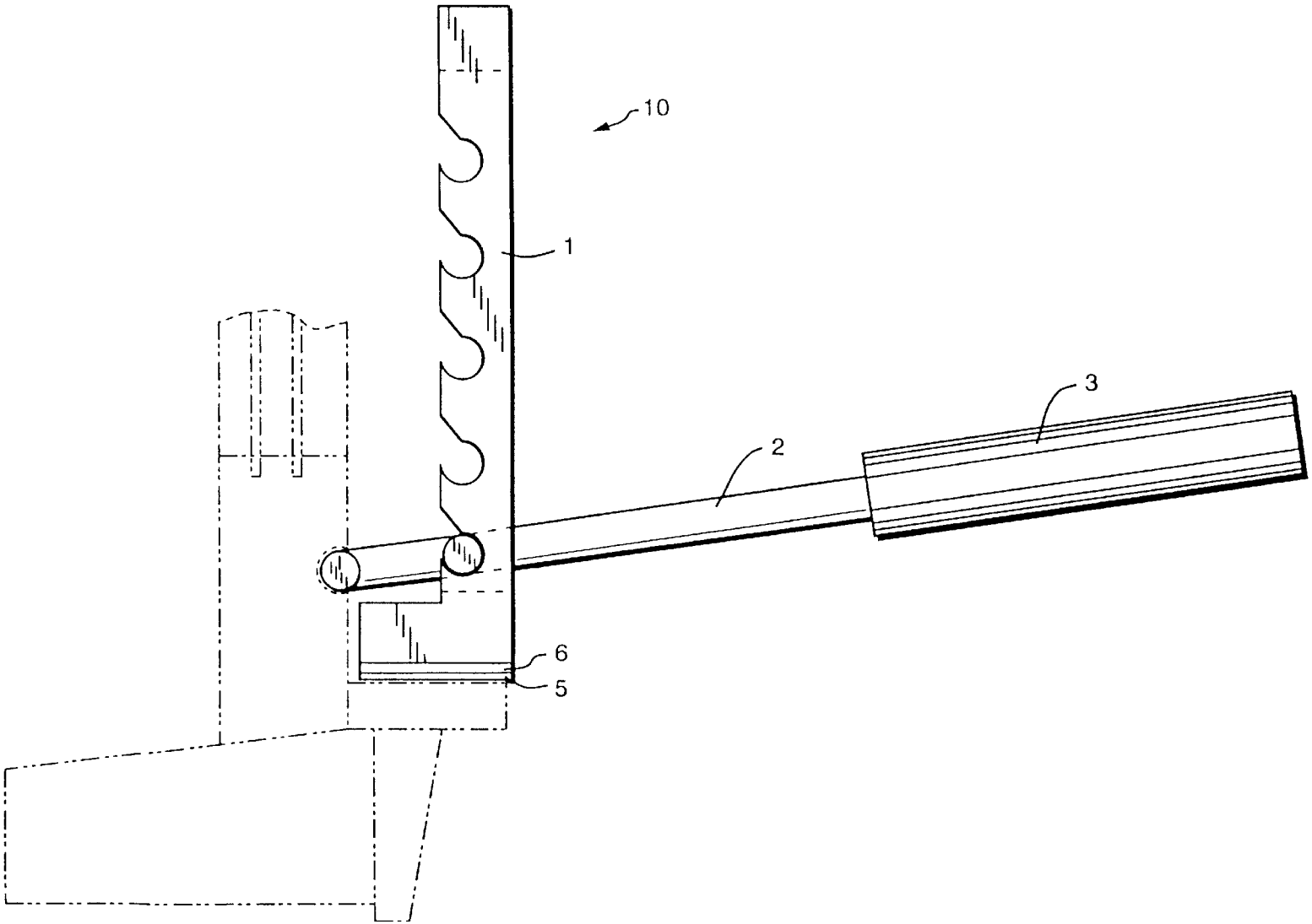
FIG. 7 is a side view of the embodiment, 10, in place on a simulated inside window sill. The lever's lower crossbars are inserted in a factory machined fingerhold on the frame of the simulated window. The fingerhold will serve as a focal point for leveraging purposes. The lever's upper crossbars are resting on the fulcrum's lowest indent.

FIG. 7 shows the embodiment, 10, properly positioned on the inner window sill of a simulated sticking window. The lever's lower crossbars are inside a half-round fingerhold factory machined into the material of the frame. This existing fingerhold is being used as the focal point for the lifting action of the lever's lower crossbars. The lever's upper crossbars are resting on the fulcrum's lowest ratcheting indent. A leveraging operation will normally begin with the crossbars in these positions when a window is closed.

If, in a real situation, a half-round fingerhold that is factory machined into the frame of a sticking window proves not to be deep enough or for other reasons the disclosed lever's lower crossbars tend to slip out of it during a leveraging operation before any upward movement or freeing of a sticking window frame is achieved, part 4 of the disclosed invention should be installed as a focal point because of its positive ability to sustain an upward leveraging action against a firmly stuck window frame.

In the above "Description Of The Preferred Embodiment", it should be understood that the optimal dimensional relationships for the parts of the invention, to include variations in size, materials, shape, form, function and manner of operation, assembly and use, are deemed to be readily apparent to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and manner of operation shown and described, and accordingly, all suitable modifications and equivalents may be resorted to, falling within the scope and spirit of the invention.

What is claimed is:

1. A leverage tool for opening a window having a focal point and a sill having a width, wherein said tool is adapted to sit on said sill, comprising, a lever comprising, a handle having an outside diameter, a proximal end and a distal end, a first and second set of crossbars, parallel to each other and perpendicular to said handle, each having an outside diameter substantially equal to said outside diameter of said handle, wherein said handle bisects said first set of crossbars at said distal end and is adapted to engage said focal point of said window; and a fulcrum, comprising, a base having a front edge and a back edge, and an upright body, comprising two vertical support structures integral with each other at a top and a bottom of said body, and perpendicular to said base, a longitudinal central aperture, perpendicular to said base, having a width that is larger than said diameter of said handle and said crossbars to allow said crossbars and said handle to pass through said aperture, and a plurality of corresponding pairs of indents having an opening on at least one side and provided in said support structures between said top and said bottom of said body, wherein each pair of said indents is parallel to said base and is bisected by said aperture, and wherein said opening of said indents is adapted to receive said second set of crossbars of said lever.

2. The leverage tool of claim 1, wherein said body is fixed to said base so that said vertical support structures are closer to said back edge of said base than to said front edge.

3. The leverage tool of claim 1, wherein said crossbars have a substantially identical overall shape and length.

4. The leverage tool of claim 1, wherein said second set of crossbars is integral with said handle.

5. The leverage tool of claim 1, wherein said handle bisects said second set of crossbars.

6. The leverage tool of claim 1, further comprising an elastomeric end section around said proximal end of said handle.

7. A leverage tool for opening a window having a focal point and a sill having a width, wherein said tool is adapted to sit on said sill, comprising, a lever comprising, a handle having an outside diameter, a proximal end and a distal end, a first and second set of crossbars, parallel to each other and perpendicular to said handle, each having an outside diameter substantially equal to said outside diameter of said handle, wherein said handle bisects said first set of crossbars at said distal end and is adapted to engage said focal point of said window, and wherein said crossbars have a substantially identical overall shape and length; and a fulcrum, comprising, a base having a front edge and a back edge, and an upright body, comprising two vertical support structures integral with each other at a top and a bottom of said body, and perpendicular to said base, a longitudinal central aperture, perpendicular to said base, having a width that is larger than said diameter of said handle and said crossbars to allow said crossbars and said handle to pass through said aperture, and a plurality of corresponding pairs of indents having an opening on at least one side and provided in said support structures between said top and said bottom of said body, wherein each pair of said indents is parallel to said base and is bisected by said aperture, and wherein said opening of said indents is adapted to receive said second set of crossbars of said lever, and wherein said body is fixed to said base so that said vertical support structures are closer to said back edge of said base than to said front edge.

* * * * *